United States Patent [19]

Thurston et al.

[11] 4,258,456

[45] Mar. 31, 1981

[54] SHOELACE HOLDER

[76] Inventors: Jay D. Thurston, c/o George Spector, 3615 Woolworth Building, 233 Broadway; George Spector, 3615 Woolworth Building, 233 Broadway, both of New York, N.Y.

[21] Appl. No.: 48,136

[22] Filed: Jun. 13, 1979

[51] Int. Cl.[3] ..... F16G 11/00; A44B 21/00; A43C 1/00

[52] U.S. Cl. ..... 24/117; 24/121; 24/243 K; 24/245 R

[58] Field of Search ..... 24/127, 118, 117, 121, 24/245 R, 245 A, 243 K, 115 R, 120; 2/245; 36/136

[56] References Cited

U.S. PATENT DOCUMENTS

| | | | |
|---|---|---|---|
| 2,268,644 | 1/1942 | Dahlberg | 24/117 R |
| 2,636,237 | 4/1953 | Price | 24/121 |
| 3,418,733 | 12/1968 | Tyrrell et al. | 24/117 R |

FOREIGN PATENT DOCUMENTS

| | | | |
|---|---|---|---|
| 62830 | 2/1913 | Switzerland | 24/121 |

*Primary Examiner*—Roy D. Frazier
*Assistant Examiner*—Alexander Grosz

[57] ABSTRACT

A pair of devices mountable on a shoe for anchoring a center of a shoe lace, each device, in one design, including a leather pad affixed to the shoe and a removable cap being attached on top of it by means of a tongue and clamp securement, the shoe lace being laid across the clamp before the cap is attached.

4 Claims, 7 Drawing Figures

Fig. 1
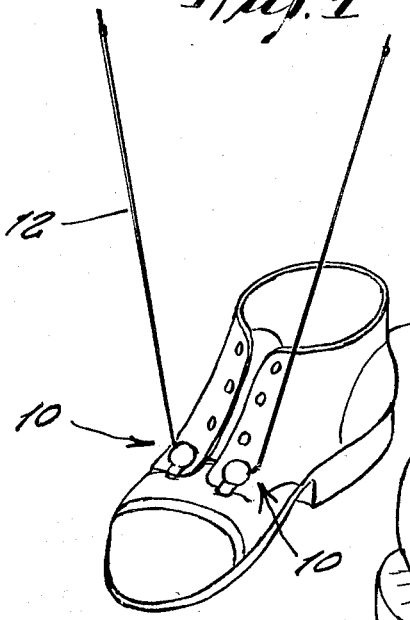
Fig. 2
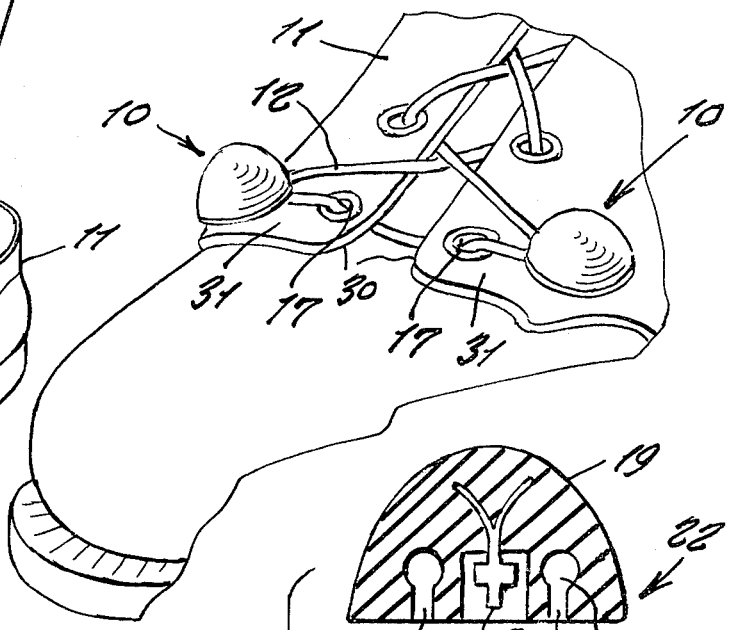
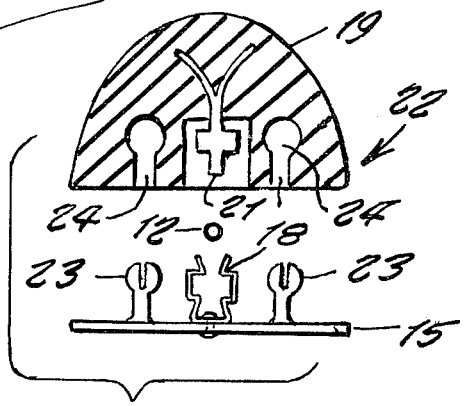
Fig. 4
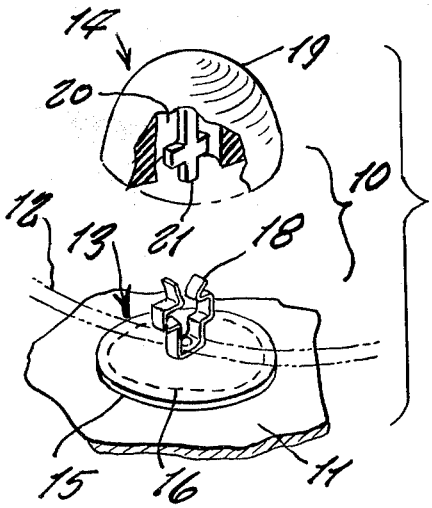
Fig. 3
Fig. 5
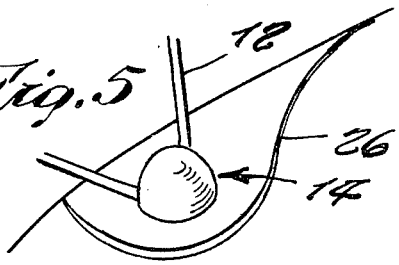
Fig. 6
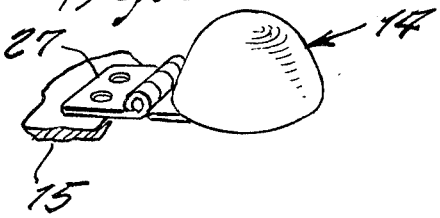
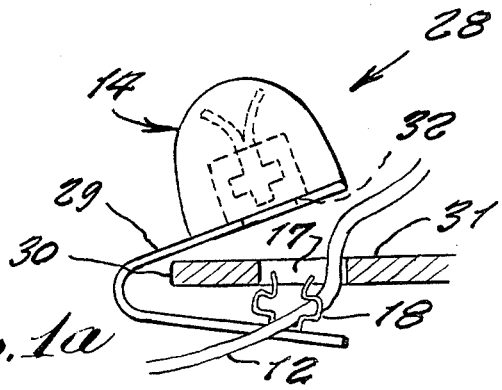
Fig. 1a

SHOELACE HOLDER

This invention relates generally to shoe accessories.

It is well known that after a period of use, one end of a shoe lace that is laced in a shoe, becomes longer than the other end, so that it finally becomes difficult to tie an attractive bow, whereby a person is obliged from time to time to pull the shoelace small portions that are located between the shoelace holes, and pulling them in one direction until the shoelace ends are equalled in length. This is time consuming so that this situation is therefore in want of an improvement.

Accordingly, it is a principal object of the present invention to provide a pair of shoelace holders attachable to a shoe, and which retain a shoelace so that its ends do not become gradually unequal in length.

Another object is to provide a pair of shoelace holders which can be quickly and easily applied by any person to his own shoes without the need of a shoemaker to do for him.

FIG. 1 is a perspective view of a shoe incorporating one design of the shoe lace holder fitted through the shoe lace holes.

FIG. 1*a* is an enlarged cross sectional view of one of the holders illustrated in FIG. 1 and which shows the top and bottom elements formed together at opposite ends of a metal band that extends around the edge of the shoe lace hole flaps, so to eliminate sewing or gluing, the device being shown prior to being clamped together.

FIG. 2 shows a design of shoe lace holders secured adjacent the shoe lace holes.

FIG. 3 is a detail of the holder components of FIG. 2, shown detached.

FIG. 4 is a cross section of a modified design thereof that includes additional snap fitting elements.

FIG. 5 shows a binder having a bottom pad of decorative shape.

FIG. 6 shows a holder top element that is hinged to pad 15.

Referring now to the drawing in greater detail, and more particularly to FIGS. 1 to 3 thereof at this time, the reference numeral 10 represents a pair of shoelace holders according to the present invention and which are affixed on a shoe 11 for retaining a shoelace 12 from gradually being pulled outwardly at its one end.

Each shoe holder includes an anchor 13 rigidly affixed to a shoe and a removable cap 14 between which the shoelace is extended.

The anchor consists of a leather pad 15 attached to the outer side of a shoe either by adhesive or by a stitched thread 16, the pad being located nearby a lowermost lacehole 17 of the shoe, or otherwise permanently mounted on the shoe.

The cap consists of an upwardly rounded button 19 made of rubber and having a recess 20 on its underside into which the clamp 18 is receivable so to engage a tongue 21 molded in the button and protruding into the recess.

In use, the shoelace is laid across the clamp as shown in FIG. 3, after which the cap is snapped over it so to lock the shoelace from pulling toward either of its ends.

In FIG. 4, a modified design of shoelace holder 22 is a same as shoelace holder 10 except that it additionally includes studs 23 on the anchor that snap fit into holes 24 on a bottom of the cap, for additional tight holding.

As shown in FIG. 5, the pad 26 secured to the shoe, may be made in any attractive shape so to add appeal to the design of a shoe.

Instead of completely removing a cap off an anchor 13, in order to place a shoelace thereacross, the cap may be made attached permanently to the pad by a hinge 27. This will prevent accidental loss of the cap, such as being pulled off when walking through tall weeds or bushes that might otherwise pull it off.

It is to be understood that the design of the shoelace holders can be changed from the above-described contruction if so preferred by a manufacturer, and yet be covered by the scope of this invention. Thus the clamp can be made attached at the cap button, and the tongue attached to the pad instead. The cap button can be made larger or smaller, and in any other shape, as wished. The securing tongue or clamp can alternately extend fully through a top of the cap button made, as so wished.

In FIG. 1*a*, another design of shoelace holder 28 includes the above-described cap 14 attached permanently to one end of a generally U-shaped clip 29 made of non-spring steel, and the above described clamp 18 being permanently attached to the other end of the clip. The clip is fitted around an edge 30 of a shoe flap 31 having the lace holes 17. The shoelace is laid across the clamp, and the clamp is then inserted through the lacehole 17, after which the clip is squeezed tight so that the cap comes down to snap fit on the clamp, thus locking the shoelace extending through the lacehole. This design has the single unit advantages of the design shown in FIG. 6, and is less costly due to less parts. The clip includes a hole 32 therethrough for allowing the clamp to pass and engage the tongue.

What is claimed:

1. A shoelace holder, comprising in combination a cap and and anchor, said anchor including a clamp made of spring steel, said cap including a rubber button having a recess in its underside, a tongue molded in said button projecting into said recess for engaging said clamp, so that a shoelace extended across said clamp is secured in said holder, and said anchor being clipped or otherwise fastened to a shoe, wherein said anchor additionally includes a non-spring steel clip of generally U-shaped configuration for fitting around an edge of a shoe flap, said cap being secured at one end of said clip and said clamp being secured at its other end for engagement together after said clamp is inserted through a shoelace hole.

2. A shoelace holder, comprising in combination a cap and anchor, said anchor including a clamp made of spring steel, said cap including a rubber button having a recess in its underside, a tongue molded in said button projecting into said recess for engaging said clamp, so that a shoelace extended across said clamp is secured in said holder, said anchor being clipped or otherwise fastened to a leather pad attached on the outer side of a shoe, wherein said cap is secured to said pad by a hinge.

3. The combination as in claim 2 wherein studs on said anchor snap fit in holes on said cap.

4. The combination as in claim 3 wherein said pad is ornamentally shaped.

* * * * *